US008651487B2

(12) United States Patent
Holmes

(10) Patent No.: US 8,651,487 B2
(45) Date of Patent: Feb. 18, 2014

(54) PUSH BUTTON PUZZLE WITH INTERNAL LOCKING MECHANISM

(76) Inventor: Mark J. Holmes, Haymarket, VA (US)

( * ) Notice: Subject to any disclaimer, the term of this patent is extended or adjusted under 35 U.S.C. 154(b) by 305 days.

(21) Appl. No.: 13/071,496

(22) Filed: Mar. 24, 2011

(65) Prior Publication Data

US 2011/0266749 A1 Nov. 3, 2011

Related U.S. Application Data

(60) Provisional application No. 61/316,981, filed on Mar. 24, 2010.

(51) Int. Cl.
*A63F 9/08* (2006.01)

(52) U.S. Cl.
USPC ..... 273/153 S; 70/289

(58) Field of Classification Search
USPC ..... 273/153 S, 156, 153 R; 70/289
See application file for complete search history.

(56) References Cited

U.S. PATENT DOCUMENTS 2,905,474 A * 9/1959 Jahr ..... 273/153 R
3,847,398 A * 11/1974 Kidd ..... 70/289
4,397,466 A * 8/1983 Nichols ..... 273/156
4,811,948 A * 3/1989 Gutierrez ..... 273/156
5,035,430 A * 7/1991 Suzuki ..... 273/153 S
5,125,661 A * 6/1992 Jarboe ..... 273/156
5,330,186 A * 7/1994 Jones ..... 70/289
5,419,558 A * 5/1995 Jones ..... 273/153 S
5,520,396 A * 5/1996 Therrien ..... 273/156
5,564,703 A * 10/1996 McGuire ..... 273/153 S
2009/0039600 A1* 2/2009 Lucas ..... 273/156

* cited by examiner

*Primary Examiner* — Steven Wong

(74) *Attorney, Agent, or Firm* — Whitham, Curtis, Christofferson & Cook, P.C.

(57) ABSTRACT

A puzzle toy that includes a plurality of push buttons that normally project from the surface of a cubic or spherical body. As the buttons are pushed in one at a time a latching mechanism residing within the body holds the buttons in a pushed-inwardly state, given a correct sequence of a subset of the buttons was pushed, deduced by logic and memory and including a chance mechanism. However if an incorrect sequence of the selected subset of button pushing is employed all the buttons so far pushed in will all pop back out at the same time at or before the time the last button is pushed in, forcing the player to start all over. The puzzle is solved when all buttons are pushed in flush with the body of the toy.

16 Claims, 14 Drawing Sheets

Flow chart of.....
6 button electro-mechanical puzzle with on off switch,battery compartment, 4 level difficulty switch (#1 level easiest to #4 level most difficult).

Chart #1 chart #2

Chart #3

Chart #4

PUSH BUTTON PUZZLE WITH INTERNAL LOCKING MECHANISM

This application claims priority from U.S. Provisional Patent Application No. 61/316,981 titled "PUSH BUTTON PUZZLE WITH INTERNAL LOCKING MECHANISM" filed on Mar. 24, 2010.

BACKGROUND OF THE INVENTION

1. Field of the Invention

The present invention relates generally to amusement devices and toys and, more specifically to a puzzle toy having a set of projecting buttons which are pushed inwardly by a player.

2. Background Description

One other puzzle toy with push pins or buttons is known to exist whereby the object of the game is to push in all six projections. This puzzle is described in U.S. Pat. No. 5,035,430 to Suzuki. The problem with it is that with each push of the projections the sequence of solving the puzzle changes whereby projections pop out randomly and have to be pushed back in randomly, thus making the solving of the puzzle strictly by chance and no logic or memory plays a part.

SUMMARY OF THE INVENTION

A goal of the present invention is to provide a plurality of push buttons which are pushed inwardly flush with the body of the toy using logic, memory and chance. After all the buttons are pushed flush, a reset button is pushed to re-project all the buttons out in their starting position.

Another goal of the present invention is to provide a puzzle that enhances the logic and memory skills of the user.

The invention is a puzzle toy that includes a plurality of push buttons that normally project from the surface of symmetric closed body, such as a cubic or spherical body. In the preferred embodiment the shape of the puzzle is a cube. As the buttons are pushed in one at a time a latching mechanism residing within the body holds the buttons in a pushed-inwardly state if a correct sequence of buttons is pushed, where the sequence is deduced by the player using logic and memory and chance. However, if an incorrect sequence of pushing buttons is employed all the buttons so far pushed in will all pop back out at the same time at or before the time the last button is pushed in, forcing the player to start all over. The puzzle is solved when all buttons are pushed in flush with the body of the toy.

Difficulty of the puzzle depends on the number of correct sequences to solve the puzzle, as opposed to the number of incorrect sequences. The more incorrect sequences the more difficult it is to solve the puzzle. For example a six sided cube with one button on each side has 720 possible combinations. If 719 are incorrect and only one is correct the puzzle would be exceedingly difficult to solve and vice versa.

The present invention could be mechanical or electro-mechanical or virtual. The invention could also be implemented as a cube, sphere or any number of polyhedrons with any number of buttons. The latching system could be magnetic or mechanical. In the preferred implementation the latching mechanism is magnetic.

An aspect of the invention is a puzzle solution method comprising three steps. First, presenting to a user a plurality of push buttons arrayed on the outer surface of a toy. Second, providing a latching mechanism within said toy that latches each of said plurality of push buttons in a pushed-in position provided each of a selected subset of said plurality of push buttons is pushed by the user in a predetermined order, wherein said latching mechanism unlatches any latched push buttons when one of said selected subset of push buttons is pushed-in out of said predetermined order. And, finally, a third step is providing a chance mechanism that unlatches any latched push buttons upon the occurrence of an event unknown to the user, said event relating to user operation of said toy. The invention may also be embodied in an apparatus having a plurality of push buttons, a latching mechanism, and a chance mechanism as described above.

In a further aspect of the invention, the event unknown to the user is user orientation of the toy in a particular direction. In some implementations of the invention the outer surface of said toy is shaped symmetrically with respect to a spatial center of said toy. In other implementations the latching mechanism is implemented using a rotor at the spatial center of said toy, the rotor having magnets of one polarity in the direction of each push button, there being a magnet of the opposite polarity on the inner side of each said button.

In yet other implementations the latching mechanism is implemented using a rotor at the spatial center of said toy, the inner side of each button having a latching arm conformable to a receiving and locking portion located on said rotor in the direction of said each button. In another implementation of the invention a user pushing in of a button out of the predetermined order causes the rotor to rotate about an axis, thereby resetting any latched buttons. In some implementations the chance mechanism is implemented by a weight which operates to reset any latched buttons if a particular one of said push buttons is pushed in when the weight is not aligned in the direction of gravity.

In a preferred implementation the toy is in the shape of a cube and each of six push buttons is located on a different face of said cube, there being in addition a reset button located on one of said faces. In that implementation the two push buttons at either end of a rotor axis are not within said selected subset of push buttons. In another implementation the outer surface of the toy is a sphere and each of six push buttons is symmetrically spaced on the surface of the sphere, there being in addition a reset button located on the surface of the sphere.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

The operation of the invention can be understood by examining the flow charts shown in FIGS. 1A-1E. An embodiment of the invention for a six button mechanical puzzle is described in a flow chart labeled "6 button mechanical puzzle flow chart" shown in FIG. 1A. An embodiment describing operation of an electromechanical version of the 6 button puzzle is shown the four flow charts labeled "Chart #1", "Chart #2", "Chart #3" and "Chart #4" shown in FIGS. 1B-1E. It should be noted that the particular sequence of button pushes that solves the puzzle is set at the time of manufacture. Puzzles with different solution sequences can be manufactured, as will be understood by those skilled in the art.

Figure 1:
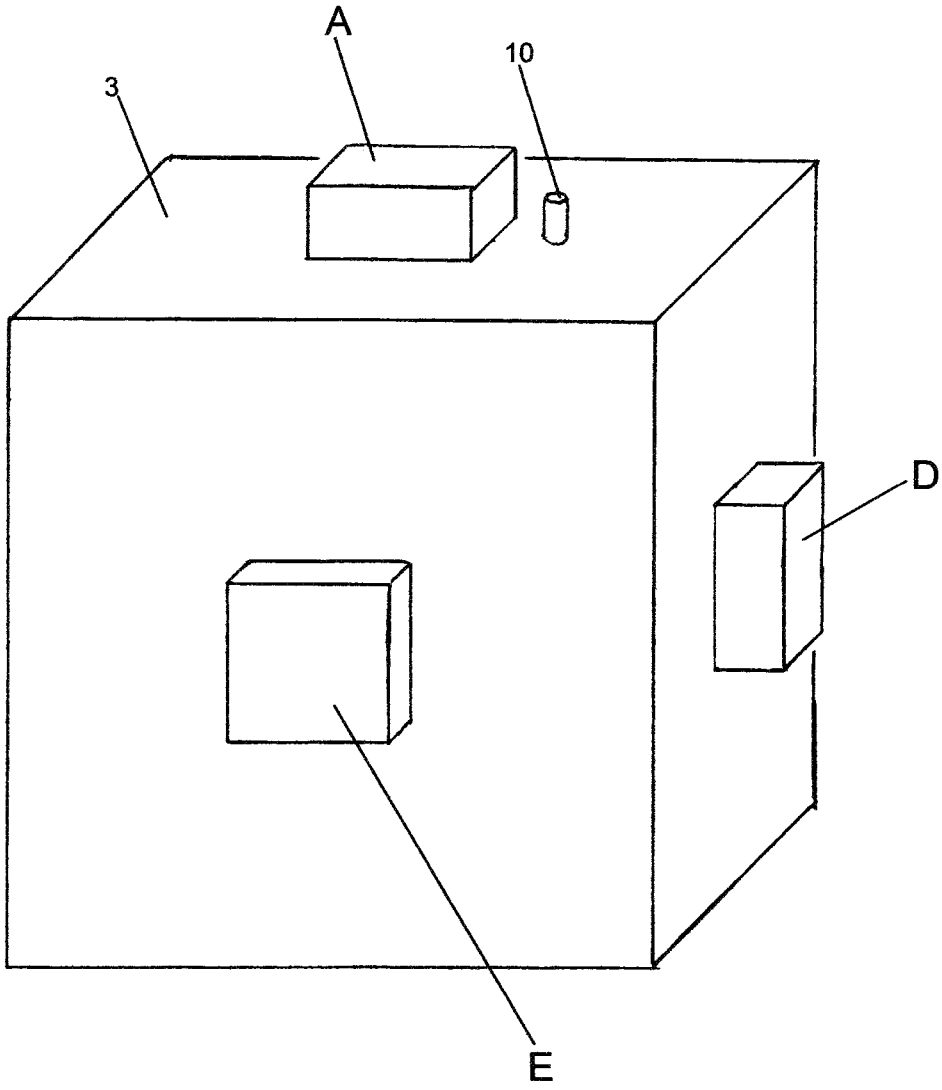
FIG. 1 is a perspective view of a preferred cubic embodiment of the present invention.
Figure 1A:
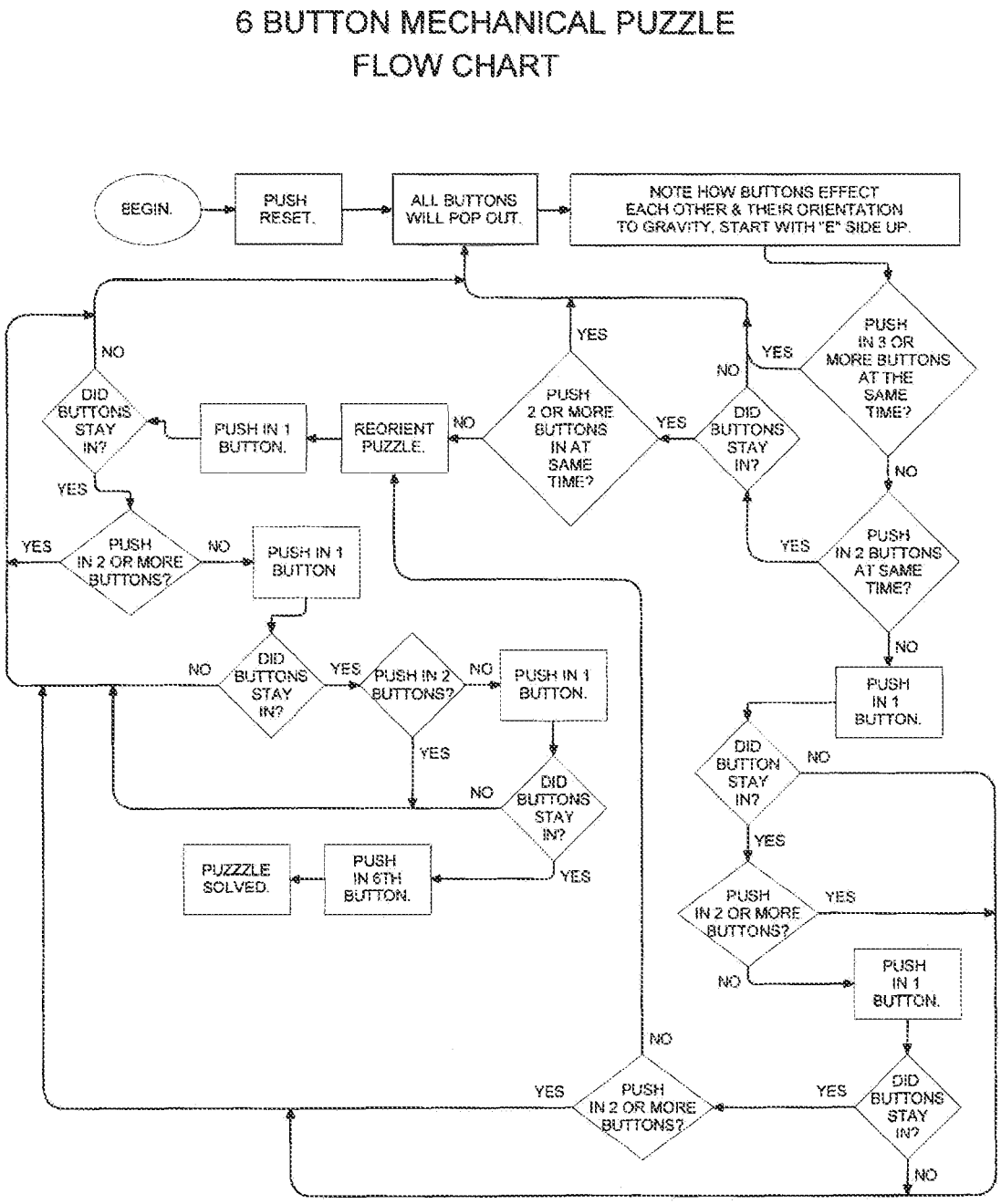
FIG. 1A is flow chart showing operation of a magnetic latching implementation of the preferred cubic embodiment of the present invention.
Figure 1B:
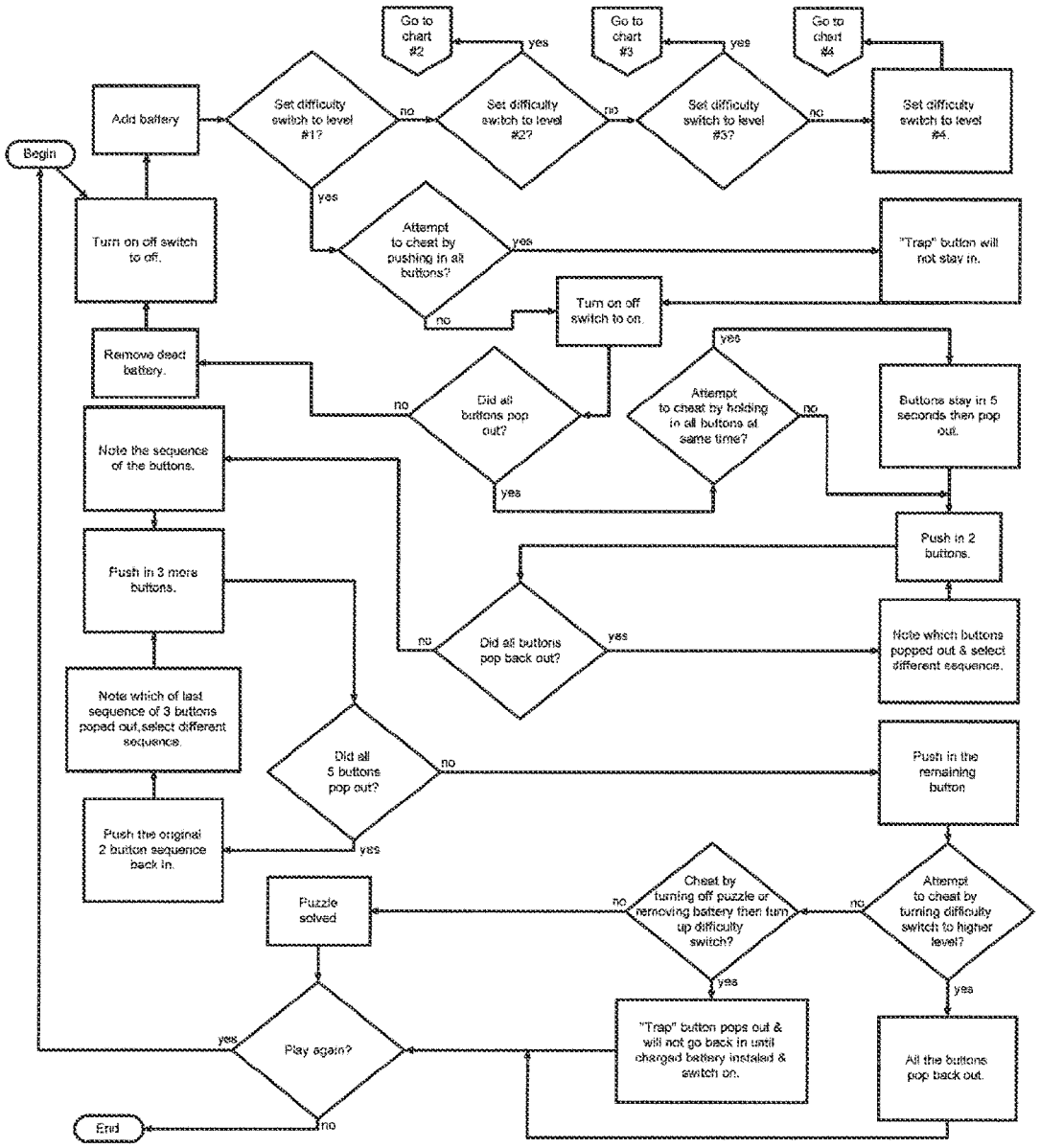
FIGS. 1B-1E are flow charts showing operation of an electromechanical implementation of the preferred cubic embodiment of the present invention.
Figure 1C:
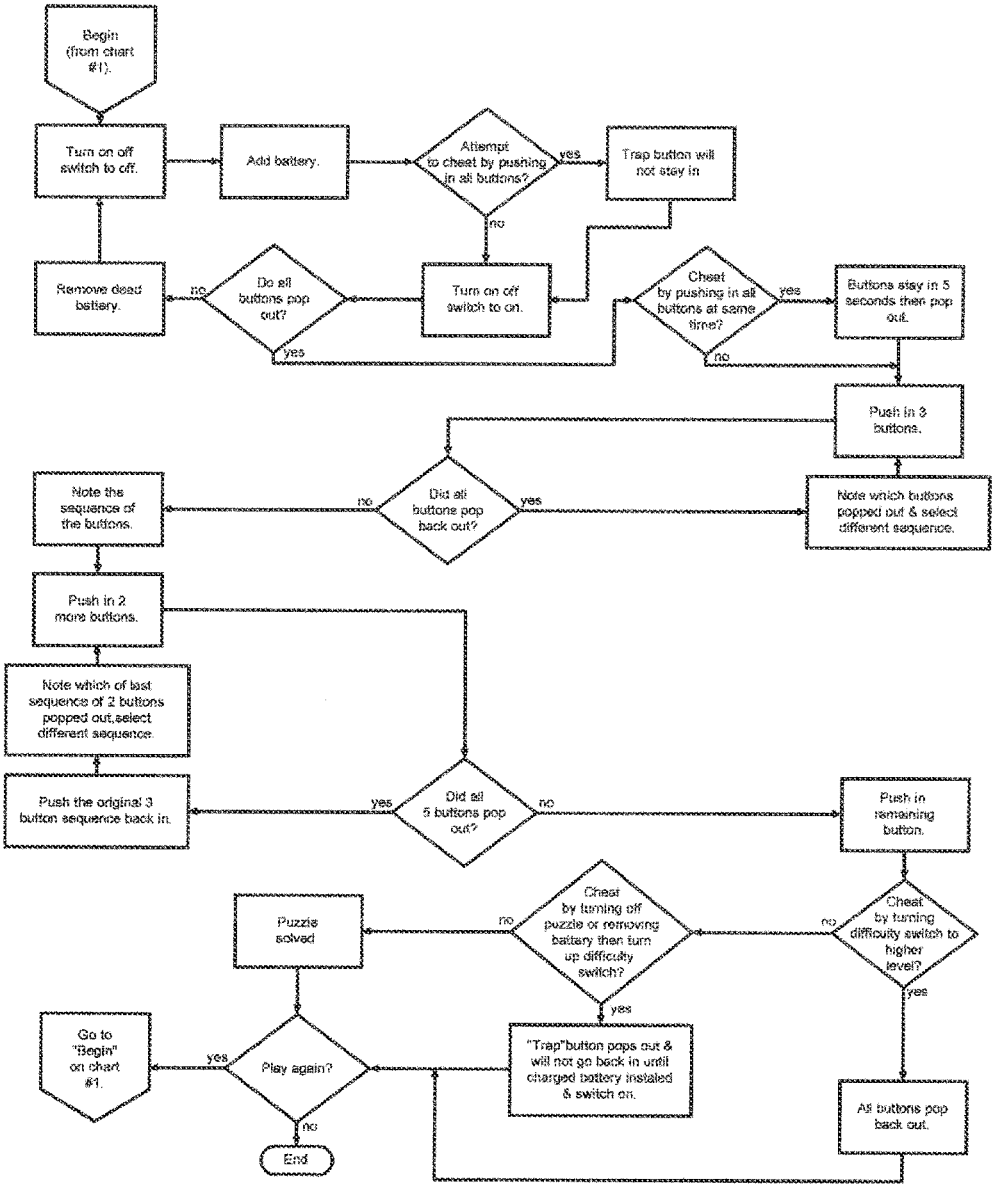
Figure 1D:
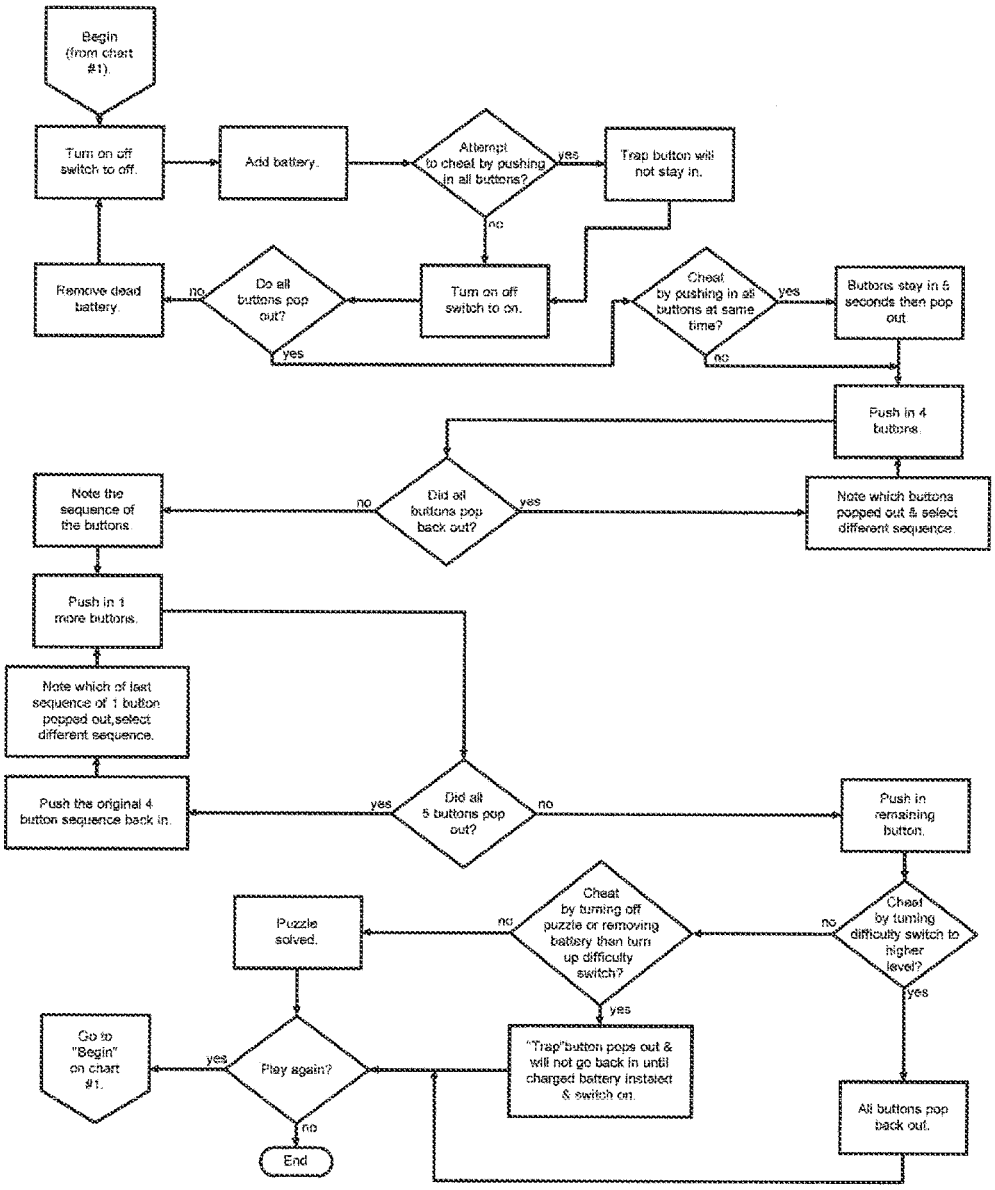
Figure 1E:
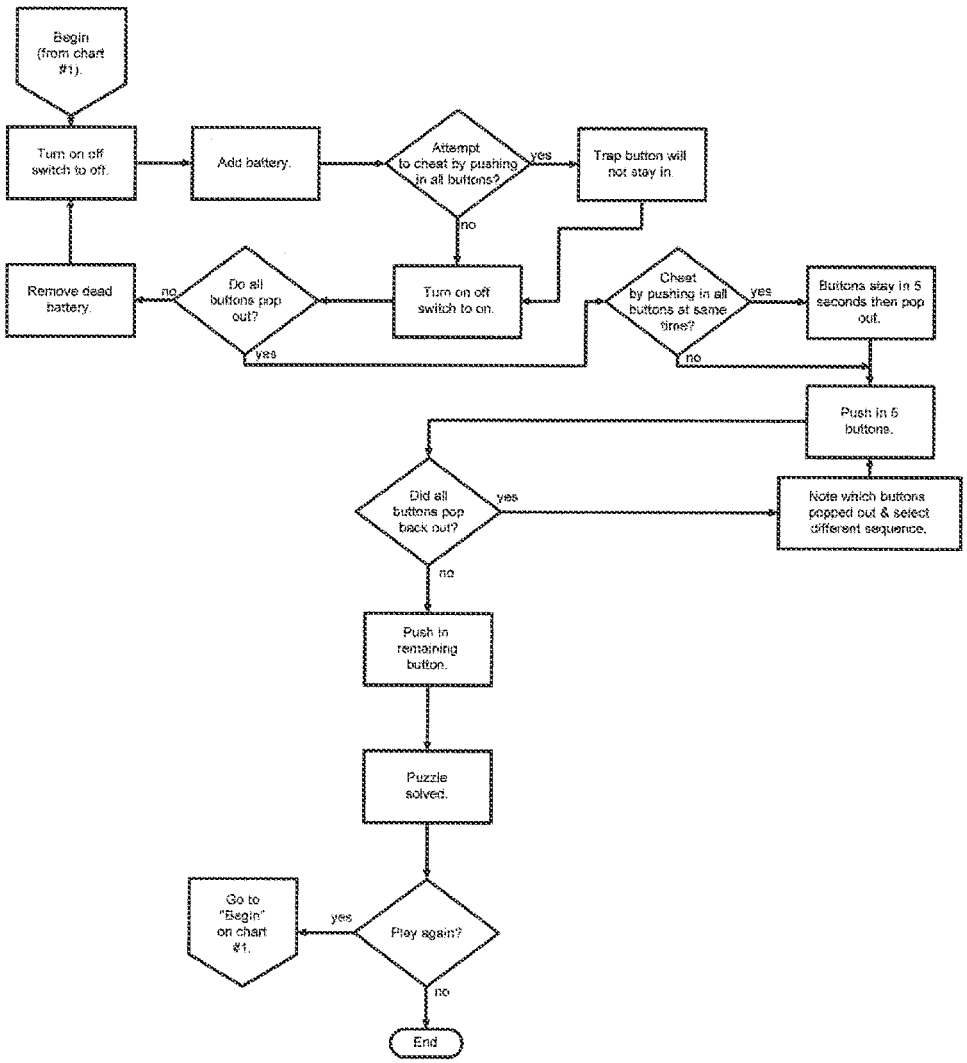
Figure 2B:
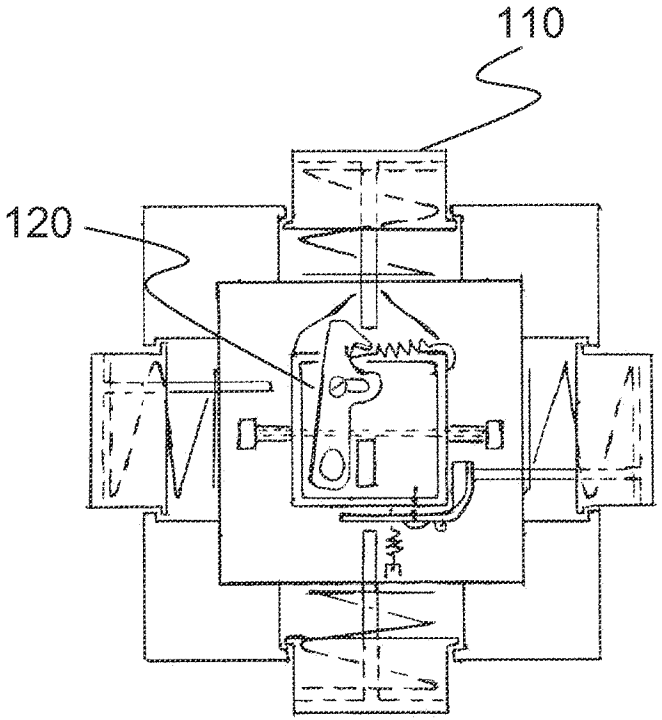
FIG. 2B is a second plan view, oriented at right angles to the plan view shown in FIG. 2*a*, with a portion of the body removed, to show the interior of the invention with a mechanical latching system.
Figure 2A:
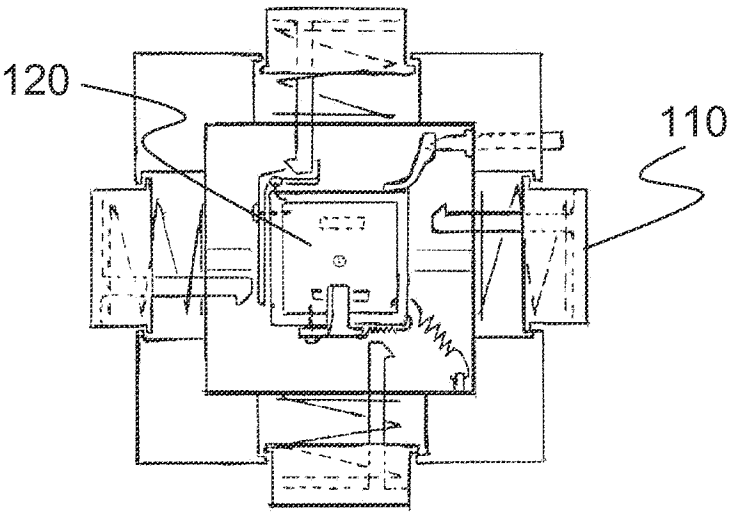
FIG. 2A is a plan view of the embodiment shown in FIG. 1, with a portion of the body removed, to show the interior of the invention with a mechanical latching system.

Referring now to FIG. 1, the preferred embodiment of the button puzzle of the present invention has a cubic shaped body which may be formed of wood or plastic and held together by screws or adhesive. The body of the puzzle in its cubic form has a button on each of the six faces of the cube, labeled A-F. On one face (e.g. on the face having button "A" as shown in FIG. 1) is a reset button 10.

Figure 3A:
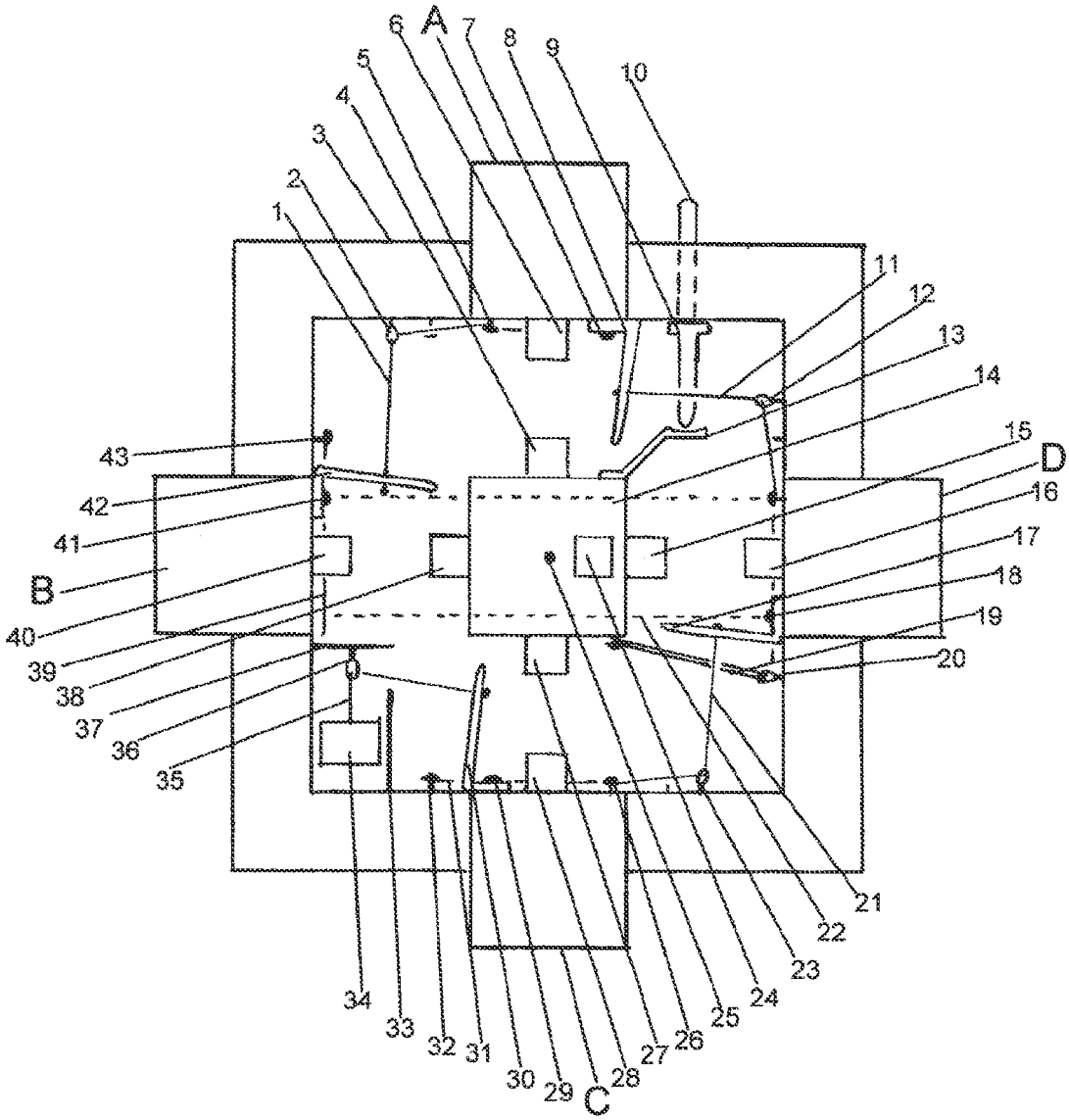
FIG. 3A is a plan view, with a portion of the body removed (button side "E"), to show the interior of the invention with a magnetic latching system.

Referring to FIG. 3A, lead weight 34 is enclosed within housing 33. Weight 34 is attached to string 35. String 35 runs through eye screw 36. Eye screw 36 is screwed into housing top enclosure 37. String 35 is attached to spring like arm 30. Arm 30 is secured to button C with screw 29. Button C has a magnet 28 secured to it with the south pole of magnet 28 facing inward toward center rotor 14. Button C has rubber band 31 running through hole 51 (FIG. 3B) in magnet 28. Rubber band 31 is secured on either side of button C by means of screw 32. Screw 32 stands out above inner surface of body 3 a small bit and an identical screw on opposite side. Rubber band 31 holds button C's inner surface flush with inner surface of body 3. When weight 34 is pointing straight down and inline with gravity it pulls on string 35, which pulls arm 30 from its normal resting position toward weight 34. If button C is pushed inwardly at this time arm 30 will not strike rotor 14. Arm 30 will slide along side of rotor 14. Button C magnet 28, with its south face facing rotor 14, will engage rotor 14 magnet 27 with its north face facing button C. The magnets will lock holding button C's outside surface flush with body 3. If weight 34 is not vertically inline with gravity, spring like arm 30 will pull string 35 and string 35 will pull weight 34, whereby arm 30 will point at the rotor 14 in its start position. If button C is pushed inwardly at this time, arm 30 will engage rotor 14 turning it $1/8^{th}$ of a revolution. All magnets will disengage and all buttons (if any are in) will pop out. Buttons will be pulled out by their respective rubber bands (which are duplicates of rubber band 31 shown on button C). If button C is successfully engaged so its outer surface is flush with body 3, button C will pull string 21 attached to button C by screw 26. String 21 which runs through eye screw 23 and is attached to spring like arm 17 through hole 62 (FIG. 3C) will pull arm 17. Arm 17 which is attached by screw 18 to button D will be pulled clear of rotor 14. If button D is pushed inward at this time arm 17 will slide up along side rotor 14 and magnet 16 with its south face pointing inward will engage and lock together with rotor 14's magnet 15 with its north face pointing outward. If reset button 10, with its integrated bulge 9 (that stops button 10 from sliding out of the close fitting shaft) is pushed while button D and button C are flush with the outer body 3, then reset button 10 will push rigid arm 13. Ridged arm 13 is attached to rotor 14 and will turn rotor 14 $1/8^{th}$ of a revolution. Rotor 14 spins on axle shaft 25. Axle 25 is mounted in rigid brackets 55 and 22 as shown in FIG. 3C. When rotor 13 is turned by means of reset button 10 all magnets will disengage and buttons D and C will be pulled to their outward positions by means of their respective rubber bands. When reset button 10 is released rotor 14 is pulled back to its starting position by means of rubber band 19. Rubber band 19 is attached to rotor 14 by screw 49 as shown in FIG. 3C. Rubber band 19 is attached to inner surface of body 3 by eye screw 20. Rotor 14 returns to its starting position and no further, being stopped by arm 13, which is stopped by bulge 9 in button 10.

If buttons C and D are successfully pushed inward button D will pull string 11. String 11 is attached to button D by a small screw. String 11 runs through eye screw 12 and attaches to spring like arm 8 through hole 45. Arm 8 is attached to button A by screw 7. String 11 pulls arm 8 clear of rotor 14. If button A is pushed in at this time, arm 8 will slide up the side of rotor 14, and magnet 6 (south face in) will engage magnet 4 (north face out) and lock together. Button A, now flush with outer body 3, pulls string 1 through eye screw 2. String 1 is attached to button A by small screw 5. String 1 pulls spring like arm 42. Arm 42 is attached to button B by screw 41. String 1 pulls arm 42 clear of rotor 14. Now button B is pushed in and arm 42 clears rotor 14. Magnet 40 (south face in) engages magnet 38 (north face out) and locks button B in the inward flush position. When button B pops back out by means of reset button 10 being pushed, rubber band 39 pulls it back to its start position.

Rubber band 39 is secured by screw 43 on one side. Band 39 goes through hole 58 in magnet and is secured to opposite side of button by a screw (duplicate of screw 43). When button B pops out its arm 42 goes back to its start position like all buttons with arms.

Buttons E and F are passive buttons. They are not directly affected by the other buttons. Pushing in button F (when rotor is in start position) magnet 54 (south face in) engages magnet 53 (north face out) and locks with same, albeit with bracket 55 sandwiched in between, which has no effect on the magnetic field if the bracket material is non-magnetic. When the rotor 14 is turned by another button or reset button 10, button F is pulled back to its starting position by rubber band 56 attached by screws 57 and 52. Button E works the same as button F. The mechanics have been explained.

Figure 3B:
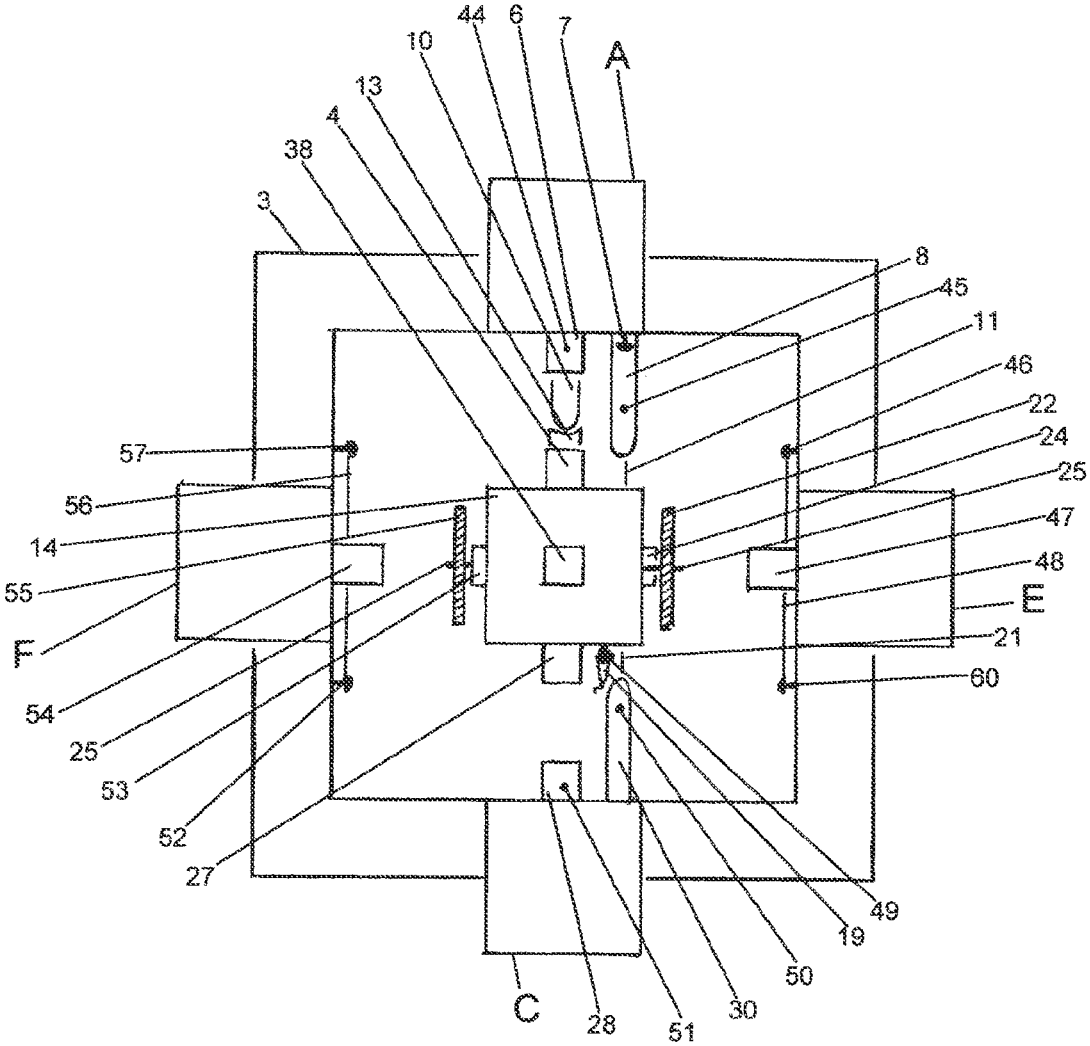
FIG. 3B is a plan view, with a portion of the body removed (button side "B"), to show the interior of the invention with a magnetic latching system.
Figure 3C:
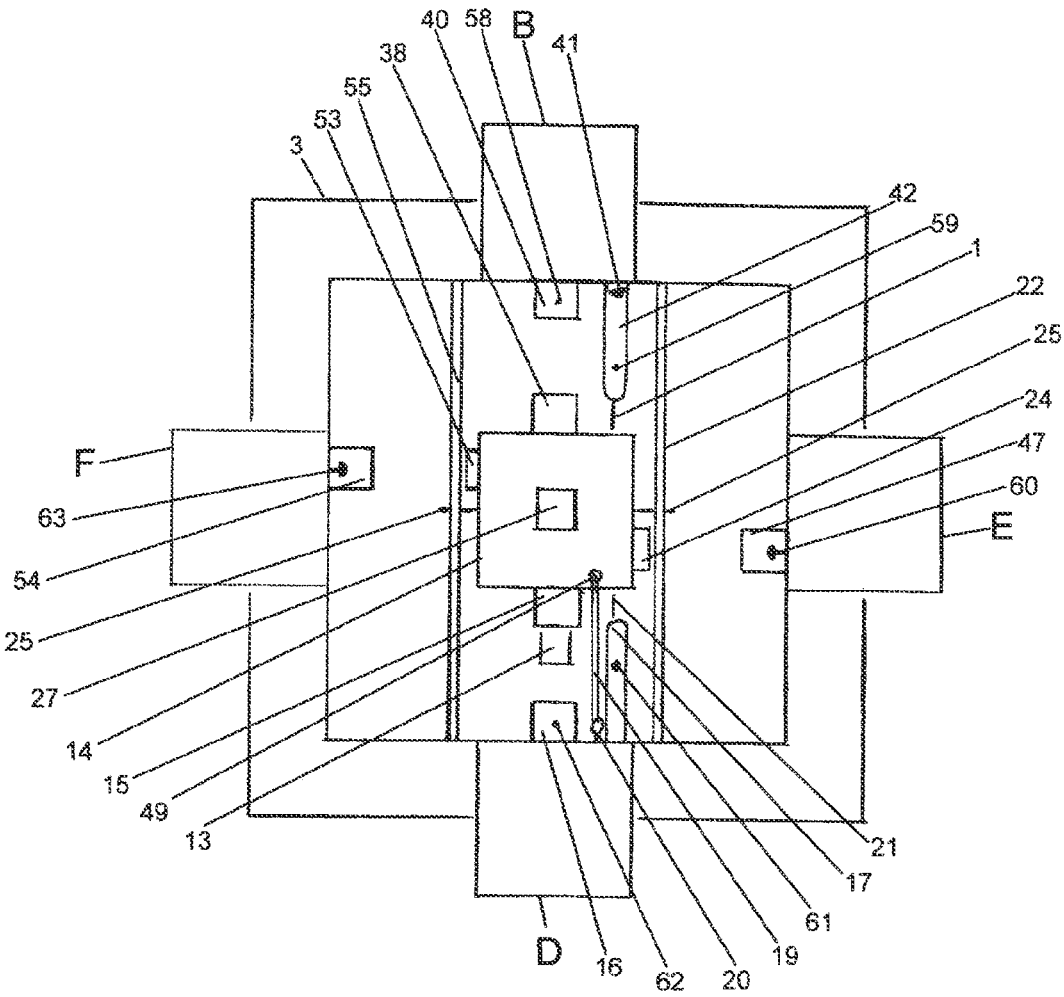
FIG. 3C is a plan view, with a portion of the body removed (button side "C"), to show the interior of the invention with a magnetic latching system.
Figure 5:
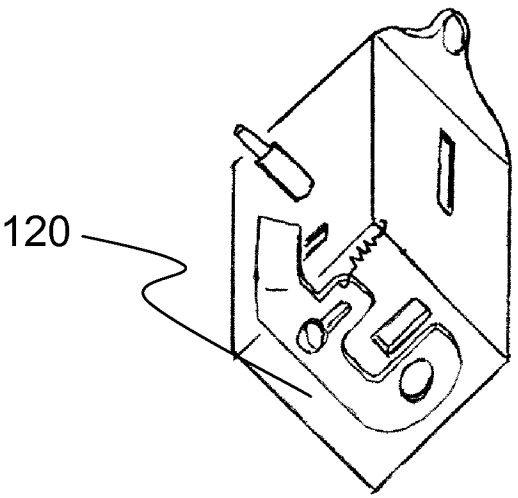
FIG. 5 is a perspective view of the internal mechanism (without supports) of the mechanical latching implementation of the cubic embodiment shown in FIG. 1.
Figure 4:
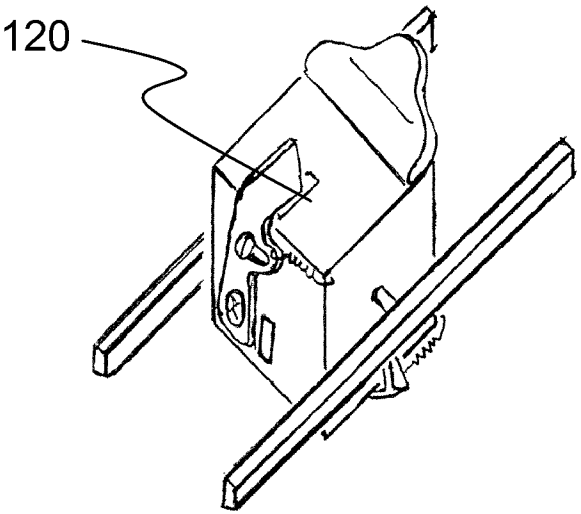
FIG. 4 is a perspective view of the internal mechanism of the mechanical latching implementation of the FIG. 1 embodiment.
Figure 7:
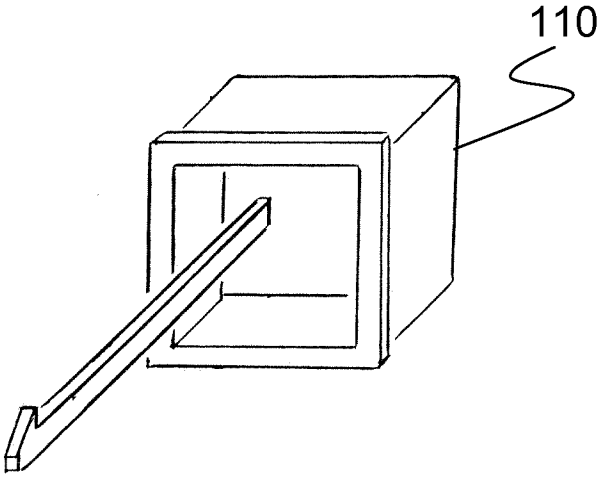
FIG. 7 is a perspective view of one of the two (parallel to central axle) buttons of the mechanical latching implementation with its attached hook.
Figure 6:
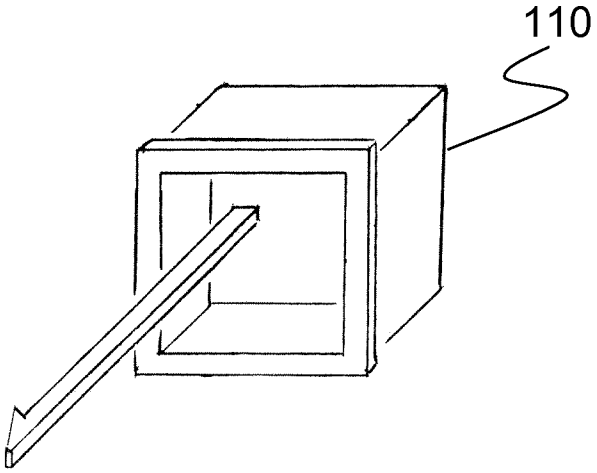
FIG. 6 is a perspective view of one of the four (perpendicular to central axle) buttons of the mechanical latching implementation with its attached hook.
Figure 9:
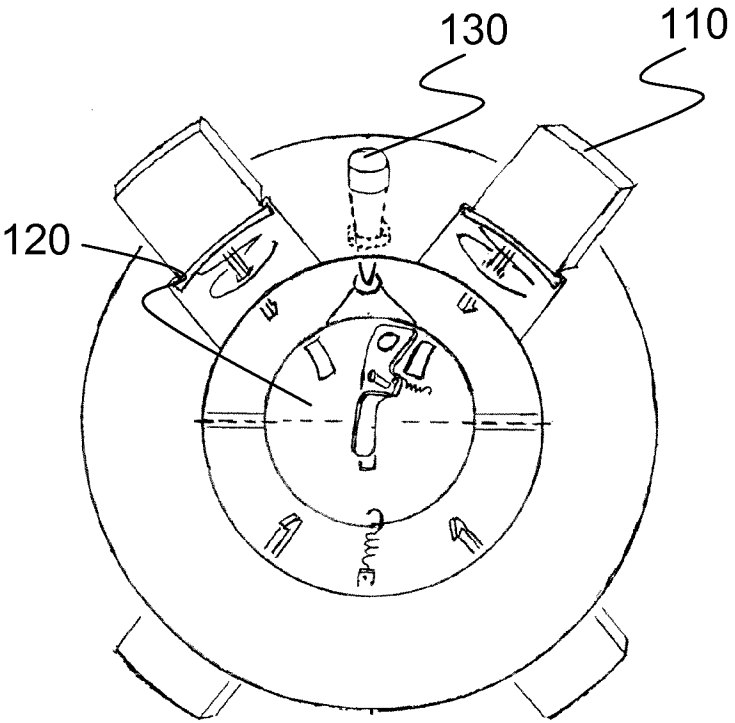
FIG. 9 is a perspective view of a spherical version of the mechanical latching implementation of the present invention with a portion of the body removed to show the interior thereof.
Figure 8:
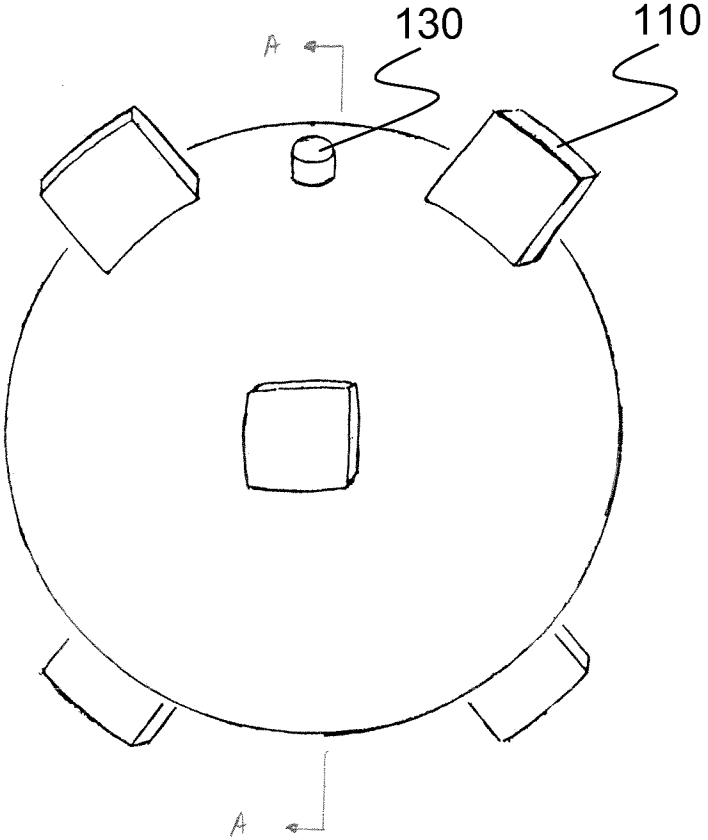
FIG. 8 is a perspective view of a spherical version of the first, preferred embodiment of the present invention.
Figure 11:
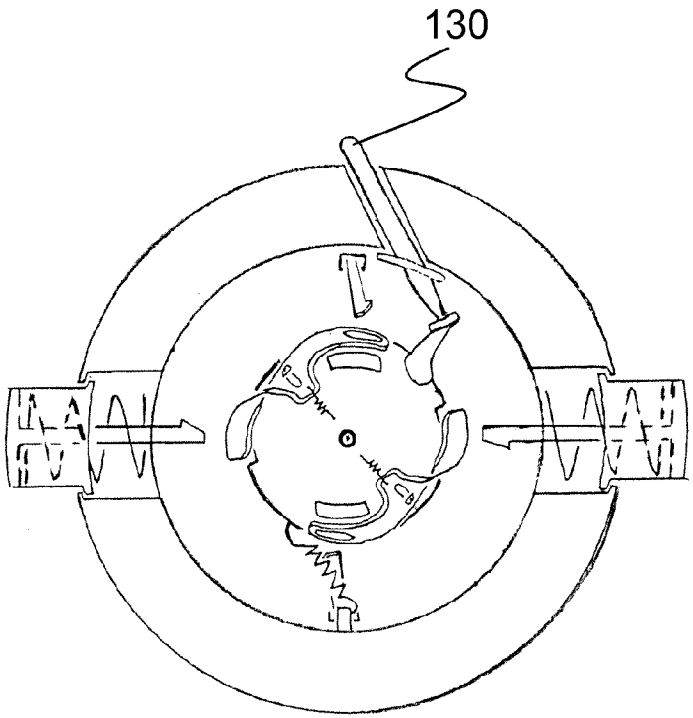
FIG. 11 is a plan view of a spherical version of the mechanical latching implementation of the present invention taken along line A-A of FIG. 8 with a portion of the body removed to show the interior thereof.
Figure 10:
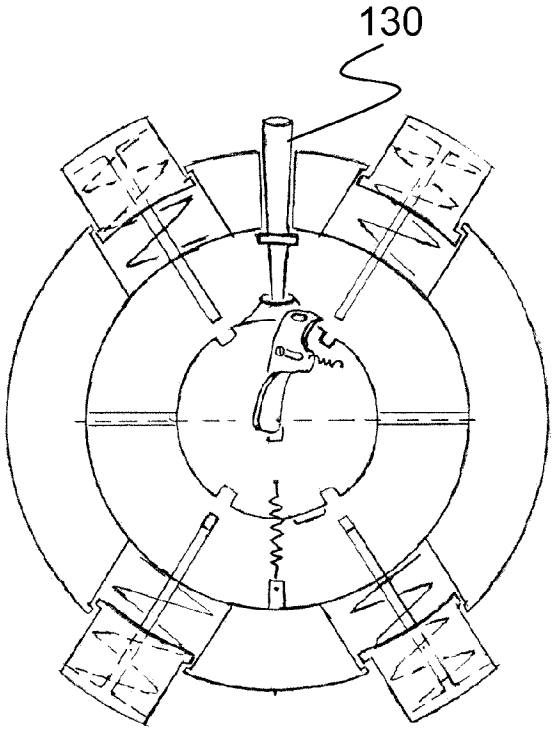
FIG. 10 is a second plan view of a spherical version of the mechanical latching implementation of the present invention with a portion of the body removed to show the interior thereof.

The following are the numbers and the parts they represent, starting at FIG. 3B button A and going clockwise: 8=spring like arm; 45=hole for string; 11=string for arm 8; 46=screw to hold band; 22=axle holding bracket; 24=rotor magnet for button E; 25=axle; 47=button E magnet; 48=button E band; 21=string for arm 30; 60=band screw; 49=screw to hold the rotors band; 19=rotor return band; 50=hole for string; 30=spring like arm; 51=hole for band; 28=magnet; 27=rotor magnet for button C; 52=band screw; 53=rotor magnet for button F; 25=axle; 54=magnet; 55=bracket; 14=rotor; 56=band; 57=band screw; 3=body; 38=rotor magnet for button B; 4=rotor magnet for button A; 13=rotor arm; 10=reset button; 44=hole for band; 6=magnet for button A; 7=screw for spring like arm;

The following are the numbers and parts they represent for FIG. 3C , starting at button F and going clockwise: 3=body of button puzzle; 53=rotor magnet for button F; 55=bracket; 38=rotor magnet for button B; 40=magnet button B; 58=hole for band; 41=screw for arm; 42=spring like arm; 59=hole for string; 1=string for arm; 22=bracket; 25=axle; 24=rotor magnet for button E; 47 =magnet button E; 60=hole for band; 21=string for arm 17; 17=spring like arm; 61=hole for string; 19=rotor band; 20=eye screw for rotor band; 62=hole for band; 16=magnet button D; 13=rotor arm; 49=screw to hold rotor band; 15=rotor magnet for button D; 14=rotor; 27=rotor magnet for button C 25=axle 54=magnet for button F; 63=hole for band.

The foregoing description details apply to the magnetic latching implementation. In the mechanical latching implementation the push buttons 110 (e.g. as shown in FIGS. 2A, 2B, 6 and 7) have a hooklike protrusion which operates the interior latching mechanism 120 (e.g. as shown in FIGS. 2A, 2B, 4 and 5). Reset button 130 has an effect similar to reset button 10 as described above.

Having thus described my invention, what I claim as new and desire to secure by Letters Patent is as follows:

1. A puzzle solution method, comprising:

presenting to a user a plurality of push buttons arrayed on the outer surface of a toy;

providing a latching mechanism within said toy that latches each of said plurality of push buttons in a pushed-in position provided each of a selected subset of said plurality of push buttons is pushed by the user in a predetermined order, wherein said latching mechanism unlatches any latched push buttons when one of said selected subset of push buttons is pushed-in out of said predetermined order; and providing a chance mechanism that unlatches any latched push buttons upon the occurrence of an event unknown to the user, said event relating to user operation of said toy, wherein the outer surface of said toy is substantially symmetrical in shape with respect to a spatial center of said toy, and wherein said latching mechanism is implemented using a rotor at the spatial center of said toy, the rotor having magnets of one polarity in the direction of each push button, there being a magnet of the opposite polarity on the inner side of each said button.

2. The puzzle method of claim 1, wherein the event unknown to the user is user orientation of the toy in a particular direction.

3. The puzzle method of claim 1, wherein said latching mechanism is implemented using a rotor at the spatial center of said toy, the inner side of each button having a latching arm conformable to a receiving and locking portion located on said rotor in the direction of said each button.

4. The puzzle method of claim 1, wherein user pushing in of a button out of the predetermined order causes the rotor to rotate about an axis, thereby resetting any latched buttons.

5. The puzzle method of claim 4, wherein said chance mechanism is implemented by a weight which operates to reset any latched buttons if a particular one of said push buttons is pushed in when the weight is not aligned in the direction of gravity.

6. The puzzle method of claim 5, wherein the outer surface of the toy is a cube and each of six push buttons is located on a different face of said cube, there being in addition a reset button located on one of said faces.

7. The puzzle method of claim 6, wherein the two push buttons at either end of said axis are not within said selected subset of push buttons.

8. The puzzle method of claim 5, wherein the outer surface of the toy is a sphere and each of six push buttons is symmetrically spaced on the surface of the sphere, there being in addition a reset button located on the surface of the sphere.

9. A puzzle apparatus, comprising:

a plurality of push buttons arrayed on the outer surface of a toy;

a latching mechanism within said toy that latches each of said plurality of push buttons in a pushed-in position provided each of a selected subset of said plurality of push buttons is pushed by a user in a predetermined order, wherein said latching mechanism unlatches any latched push buttons when one of said selected subset of push buttons is pushed-in out of said predetermined order; and a chance mechanism that unlatches any latched push buttons upon the occurrence of an event unknown to the user, said event relating to user operation of said toy, wherein the outer surface of said toy is substantially symmetrical in shape with respect to a spatial center of said toy, and wherein said latching mechanism is implemented using a rotor at the spatial center of said toy, the rotor having magnets of one polarity in the direction of each push button, there being a magnet of the opposite polarity on the inner side of each said button.

10. The puzzle apparatus of claim 9, wherein the event unknown to the user is user orientation of the toy in a particular direction.

11. The puzzle apparatus of claim 9, wherein said latching mechanism is implemented using a rotor at the spatial center of said toy, the inner side of each button having a latching arm conformable to a receiving and locking portion located on said rotor in the direction of said each button.

12. The puzzle apparatus of claim 9, wherein user pushing in of a button out of the predetermined order causes the rotor to rotate about an axis, thereby resetting any latched buttons.

13. The puzzle apparatus of claim 12, wherein said chance mechanism is implemented by a weight which operates to reset any latched buttons if a particular one of said push buttons is pushed in when the weight is not aligned in the direction of gravity.

14. The puzzle apparatus of claim 13, wherein the outer surface of the toy is a cube and each of six push buttons is located on a different face of said cube, there being in addition a reset button located on one of said faces.

15. The puzzle apparatus of claim 14, wherein the two push buttons at either end of said axis are not within said selected subset of push buttons.

16. The puzzle apparatus of claim 13, wherein the outer surface of the toy is a sphere and each of six push buttons is symmetrically spaced on the surface of the sphere, there being in addition a reset button located on the surface of the sphere.

* * * * *